US005775932A

United States Patent [19]

Saito et al.

[11] Patent Number: 5,775,932

[45] Date of Patent: Jul. 7, 1998

[54] ELECTRICAL CONNECTOR

[75] Inventors: Hitoshi Saito; Kazuto Ohtaka, both of Shizuoka, Japan

[73] Assignee: Yazaki Corporation, Tokyo, Japan

[21] Appl. No.: 732,664

[22] Filed: Oct. 16, 1996

[30] Foreign Application Priority Data

Oct. 16, 1995 [JP] Japan ..... 7-266668

[51] Int. Cl.[6] ..... H01R 13/64

[52] U.S. Cl. ..... 439/378; 439/358

[58] Field of Search ..... 439/378, 680, 439/357, 358, 352

[56] References Cited

U.S. PATENT DOCUMENTS

| | | | |
|---|---|---|---|
| 4,273,403 | 6/1981 | Cairns | 439/357 |
| 4,806,123 | 2/1989 | Konishi et al. | 439/595 |
| 5,378,168 | 1/1995 | Sumida | 439/358 |
| 5,425,650 | 6/1995 | Maeda | 439/374 |

FOREIGN PATENT DOCUMENTS

| | | |
|---|---|---|
| 0 448 084 A1 | 9/1991 | European Pat. Off. . |
| 58-41745 | 3/1983 | Japan . |
| 60-166981 | 11/1985 | Japan . |

*Primary Examiner*—Gary F. Paumen

*Attorney, Agent, or Firm*—Armstrong, Westerman, Hattori, McLeland & Naughton

[57] ABSTRACT

An electrical connector is provided in which a male connector is fitted into a female connector in such a manner that terminals are prevented from being bent even if the male connector is mistakenly fitted so as to be slanted at an angle with respect to the female connector. The electrical connector includes a male connector for sliding insertion into a female connector. A locking arm is mounted on a upper wall of the male connector. A bending preventing member protrudes from an inner wall face of the female connector and extends forwardly toward an opening of the hood of the female connector. An escape portion is formed by recessing in a front end face of the locking arm of the male connector to allow the bending preventing member of the female connector to enter thereinto. In this way, the terminals of the female connector are prevented from being bent since the bending preventing member contacts the front end face of the male connector and is not inserted into the escape portion when the male connector is mistakenly fitted so as to be slanted at an angle with respect to the female connector.

2 Claims, 8 Drawing Sheets

ELECTRICAL CONNECTOR

BACKGROUND OF THE INVENTION

1. Field of the Invention

The present invention generally relates to an electrical connector and more particularly, to an electrical connector including a male connector for slidable insertion into a female connector, wherein the female connector has a bending connecting member so that when the male and female connectors are connected with each other, even if the male connector is mistakenly fitted so as to be slanted at an angle with respect to the female connector, the terminals of the female connector are prevented from being bent.

2. Description of the Prior Art

FIG. 8 shows a female connector 20 in a conventionally used electrical connector. The female connector 20 has bending preventing ribs 22 projecting from inner wall faces 21' of a hood 21 which receives a male connector (not shown). The bending preventing ribs 22 are arranged so as to be between terminals (not shown) when the male connector is inserted into the female connector 20. When the female connector 20 and the male connector are to be connected to each other, but the male connector is mistakenly fitted so as to be slanted at an angle with respect to the female connector 20 such that the male connector and the bending preventing ribs 22 are in contact with each other, the terminal in the female connector are prevented from being bent. The term "being bent" is used in this application to mean a condition wherein male and female terminals do not electrically contact each other because any one of the male terminals is bent.

However, the conventional electric connector of FIG. 8 has the problem that because the bending preventing ribs 22 project from the inner wall faces 21' of the hood 21, the distance between the terminals in the female connector 20 becomes wide so that the female connector 20 must be made larger in size than is desirable.

FIG. 9 shows an electrical connector that includes a raised portion 24' mounted on a sidewall of a male connector 23. A locking arm 24 is mounted on the raised portion 24'. Guide ribs 25 are mounted on the sidewall of the male connector 23 on both sides of the locking arm 24. A locking arm chamber 28, within the hood 27 of the female connector 26, receives the locking arm 24 therein and guide grooves 29 of the female connector 26 receive the guide ribs 25 therewithin.

However, in the event that the male connector 26 and the female connector 23 are attempted to be connected to each other with the male connector 26 being mistakenly fitted so as to be slanted at an angle with respect to the female connector 23, the guide ribs 25 often enter into the locking arm chamber 28. If this situation occurs, the terminals 30 in the female connector 26 may be bent.

Referring to FIG. 10, an electrical connector is shown which has been disclosed in JAPANESE UTILITY MODEL APPLICATION laid-open No. 60-166981 (hereinafter JP '981). The electrical connector of JP '981 includes a engaging piece 34 formed in a locking chamber 33 of a hood 32 of a female connector 31 so as to be perpendicular to the inner wall face of the hood 32. A guide groove 37 is formed in a raised portion 36 on a front end of a male connector 35 in order to receive the engaging piece 34 therewithin to guide the engaging piece.

However, the electrical connector of JP '981 has the problem that in connecting the male connector 31 and the female connector 35, if the male connector 31 is mistakenly fitted so as to be slanted at an angle with respect to the female connector 35, a wire (not shown) and a sidewall of the hood 32 in the female connector 31 are caught by the guide groove 37, and the locking arm 38 may be deformed and damaged. Furthermore, the formation of the guide groove 37 in the raised portion 36 of the male connector 35 causes an adjusting reaction force of the locking arm 38 to be incapable of preventing the deformation and damage to the locking arm 38.

SUMMARY OF THE INVENTION

An object of the present invention is to provide an electrical connector that prevents terminals in a female connector from being bent, that prevents a locking arm from being deformed and damaged when a male connector is mistakenly fitted so as to be slanted at an angle with respect to a female connector, and that easily controls the adjusting reaction force of the locking arm of a raised portion of the male connector.

In order to attain the above-stated object, the present invention provides an electrical connector which includes a male connector and a female connector into which the male connector is to be slidingly inserted. A locking arm is mounted on a sidewall of the male connector. A bending preventing member protrudes from a rear inner wall face of the hood of the female connector so as to extend forwardly toward an opening in the hood. An escape portion is formed in a front end face of the raised portion of the male connector on the side of the male connector which is to be slidingly fitted though the opening in the hood into the female connector so that the bending preventing member of the female connector enters the escape portion of the male connector to prevent any terminals of the female connector from being bent by contacting the bending preventing member and either a front end face or a sidewall of the male connector when the male connector is mistakenly fitted so as to be slanted at an angle with respect to the female connector.

The above-stated object of the present invention may also be accomplished by providing an electrical connector including a male connector to be connected with a female connector wherein a pair of concave portions are formed in a sidewall of the male connector in a direction parallel to the direction in which the male connector is slidingly inserted into the female connector. The electrical connector also includes a locking arm formed between the concave portions of the male connector. The female connector includes a bending preventing member to be received in an escape portion of the male connector for preventing the terminals in the female connector from being bent by contacting the bending preventing member of the female connector and either a front end face or a sidewall of the male connector when the male connector is mistakenly fitted so as to be slanted at an angle with respect to the female connector. A pair of guide ribs are formed on a front end face of the male connector by recessing at least one side in the escape portion and a pair of guide grooves are formed in the hood of the female connector for receiving the guide ribs.

Moreover, the escape portion is a recess formed through a front end face in a raised portion of the male connector on which a locking arm is mounted. A locking arm chamber, which receives a locking arm is formed in the hood of the female connector. The locking arm chamber houses the bending preventing member.

In accordance with the present invention, when a male connector is mistakenly fitted so as to be slanted with respect to a female connector because either a front end face or a sidewall of the male connector and a bending preventing member of the female connector strike each other, terminals in the female connector do not electrically contact terminals in the male connector. Accordingly, because the terminals in the female connector are prevented from being bent, the terminals are not deformed and thus the male connector may be securely and speedily connected to the female connector. Also, because guide ribs formed at a front end face of the male connector are received in guide grooves of the female connector, if the male connector is mistakenly fitted so as to be slanted with respect to the female connector, the guide ribs strike the guide grooves, and the terminals are prevented from being bent.

Furthermore, because the bending preventing member protrudes forwardly into the locking arm chamber of the female connector, which locking arm chamber is for accommodating a locking arm of the male connector, the configuration of the escape portion for housing the bending preventing member is different from the configuration of conventionally used guide grooves, and the wires and the hood of the female connector are not caught by the escape portion. Therefore, the locking arm is prevented being deformed and damaged, and the reaction force of the locking arm may be easily adjusted. Furthermore, because the bending preventing member is housed within the locking arm chamber and the locking arm chamber is for receiving the locking arm, the locking arm chamber is not divided by the bending preventing member. Therefore it is possible to make use of the locking arm chamber widely.

DESCRIPTION OF THE PREFERRED EMBODIMENT

Figure 1:
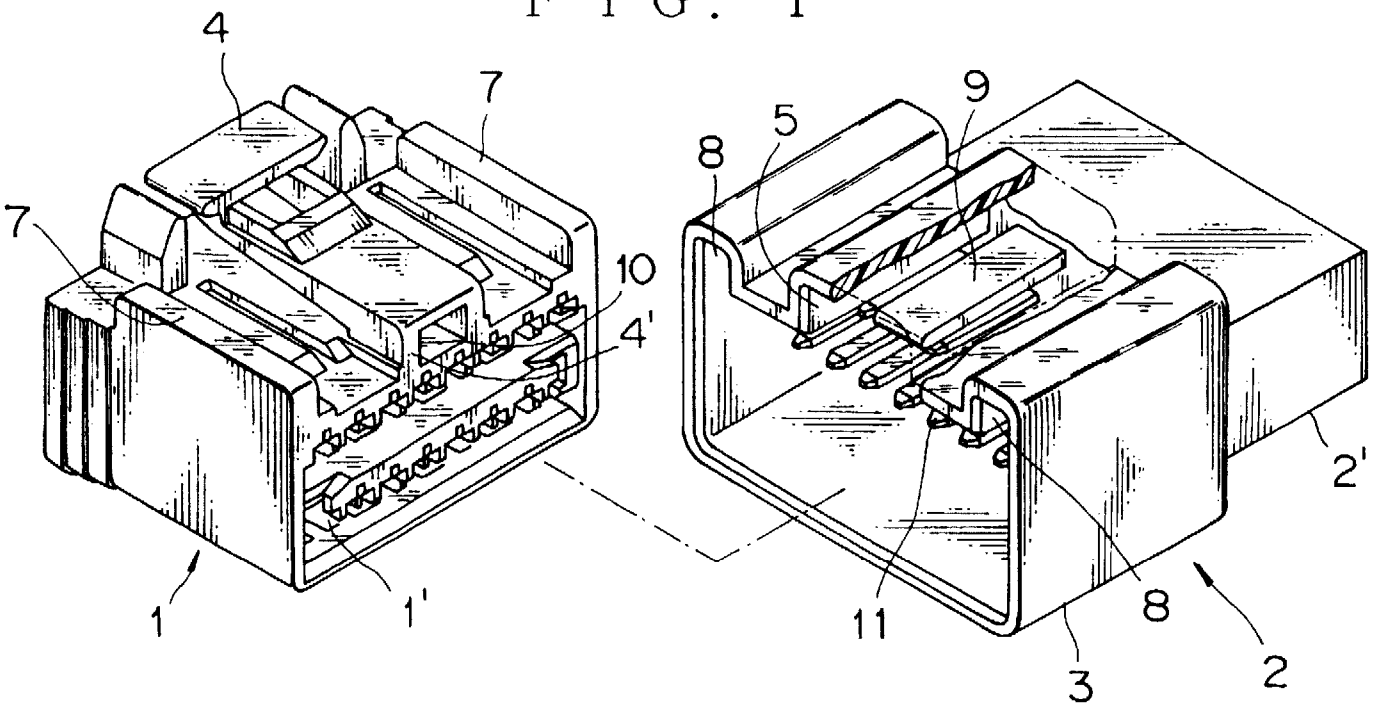
FIG. 1 is a perspective view of a first embodiment of an electrical connector according to the present invention, wherein male and female connectors thereof are shown in a disconnected state so that a portion of the female connector above a locking arm chamber, being partially cutaway, reveals a bending preventing piece.

Embodiments of an electrical connector according to the present invention will be described below in reference to the drawing figures.

Figure 2A:
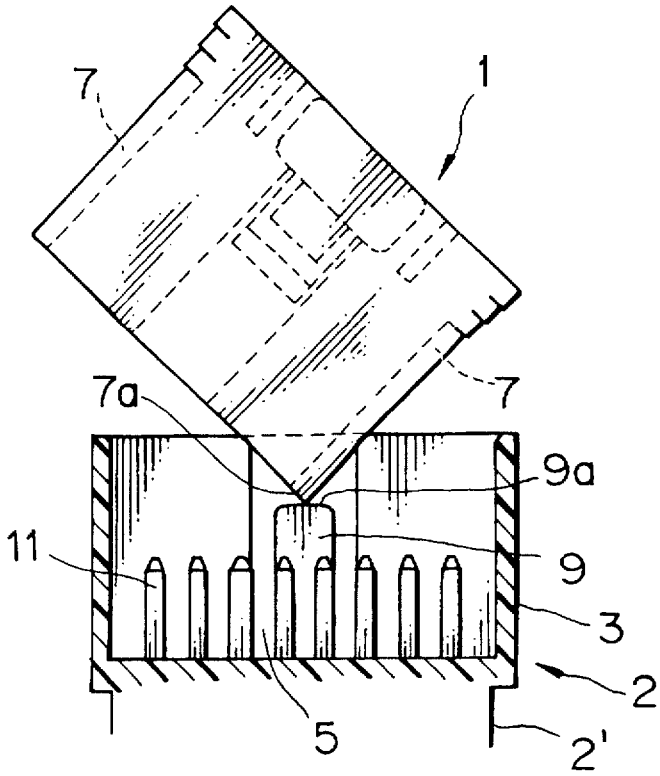
FIGS. 2A and 2B are plan views of the electrical connector of FIG. 1 showing the a male connector, with guide ribs formed at both side edges thereof, mistakenly fitted so as to be slanted at an angle with respect to the female connector, wherein FIG. 2A particularly illustrates a situation in which a tip portion of the guide ribs of the male connector directly strike a tip portion of the bending preventing member of the female connector and FIG. 2B particularly illustrates a situation in which the tip portion of the guide ribs of the male connector do not directly strike the tip portion of the bending preventing member of the female connector.
Figure 2B:
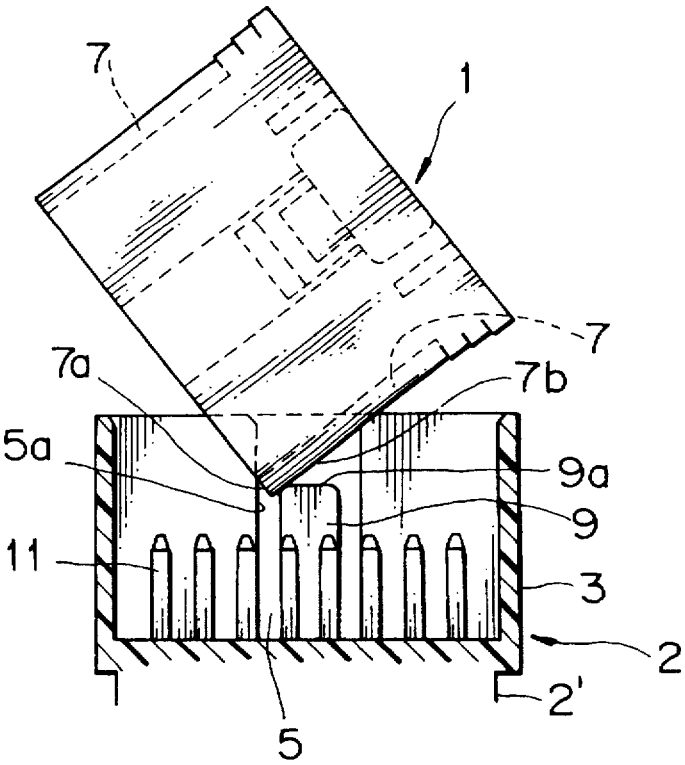
Figure 3:
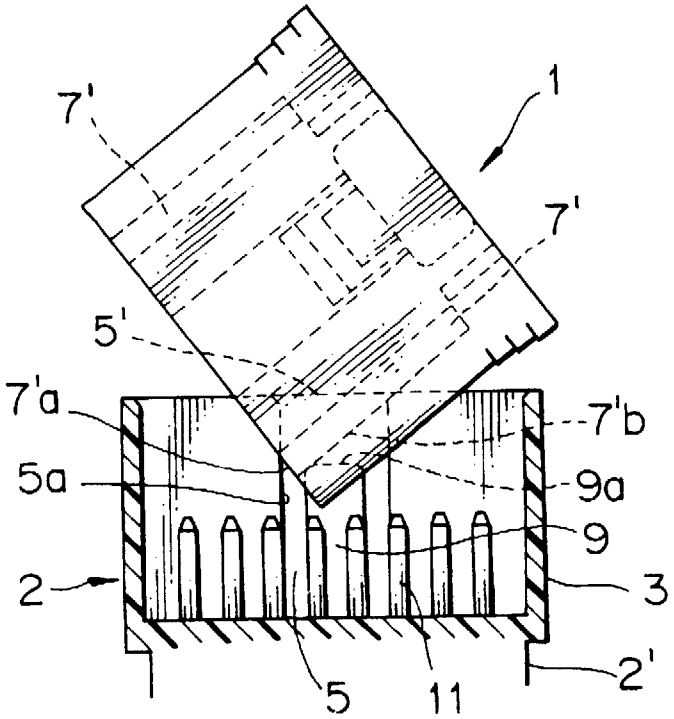
FIG. 3 is a plan view of the electrical connector of FIG. 1 showing a variation of the male connector, which has guide ribs located inwardly from the side edges, being mistakenly fitted so as to be slanted at an angle with respect to the female connector.

FIGS. 1–3 show a first embodiment of an electrical connector according to the present invention. Referring to FIG. 1, a male connector 1 and a female connector 2 are shown in a disconnected state. The male connector 1 includes plural terminal chambers 1' which are arranged in upper and lower rows. Each of the terminal chambers 1' is open to the front and to the rear of the male connector 1. A locking arm 4 is formed on a raised portion 4' which is mounted on an upper wall of the male connector 1. Guide ribs 7 are mounted on the upper wall of the male connector 1 so as to be located on both sides of the locking arm 4.

The female connector 2 includes a housing body 2' in which a hood 3 is formed at a front end thereof. The hood 3 is for accommodating the male connector 1 therewithin. A locking arm chamber 5 is formed in the hood 3 for accommodating therewithin the locking arm 4 of the male connector 1. Guide grooves 8 are formed on both sides of the locking arm chamber 5 for receiving therewithin the guide ribs 7 of the male connector 1. Terminals 11 extend from the front end of the housing body 2' into the hood 3 towards the opening 3*a* of the hood 3.

A bending preventing piece 9 is located in the locking arm chamber 5 of the female connector 2 and protrudes forwardly towards the opening 3*a* of the hood 3 from the front end of the housing body 2' to act as a member to prevent bending of the terminals 11. The bending preventing piece 9 is elastic and is formed in the shape of a thin plate. The bending preventing piece 9 is of a length no longer than the length of the terminals 11 which project from the front end of the housing body 2'. The tip of the bending preventing piece 9 may be smooth.

An escape portion 10 is formed in the raised portion 4' mounted on the upper wall of the male connector 1. The escape portion slidingly received the bending preventing piece 9 of the female connector 2. The escape portion 10 is sized so that there is surplus in space inside after the insertion of the bending preventing piece 9 therein.

Next, the operation of connecting the male connector 1 and the female connector 2, wherein the male connector 1 is mistakenly fitted so as to be slanted at an angle with respect to the female connector 2, will be explained below.

As shown in FIG. 1, guide ribs 7 extend from the upper wall of the male connector 1 along both side edges thereof. In the event that a tip portion 7*a* of one of the guide ribs 7 of the male connector 1 directly strikes a tip portion 9*a* of the bending preventing piece 9 of the female connector 2 as shown in FIG. 2A, the male connector 1 and the female connector 2 cannot be connected to each other. Referring to FIG. 2B, in the event that one of the guide ribs 7 enters into a space between an inner face of a sidewall 5*a* of the locking arm chamber 5 and the outer periphery of the bending preventing piece 9, the inner face of the sidewall 5*a* of the locking arm chamber 5 and a corner of the tip portion 7*a* of one of the guide ribs 7 strike each other. When a corner of the tip portion 9*a* of the bending preventing piece 9 of the female connector 2 and a sidewall 7*b* of one of the guide ribs 7 of the male connector 1 strike each other as shown in FIG. 2B, the male connector 1 and the female connector 2 cannot be connected to each other.

Referring to FIG. 3, the male connector 1, having guide ribs protruding from the upper wall between the outer edge of the upper wall and the raised portion 4' mounted at the center of the upper wall of the male connector 1, is mistakenly fitted so as to be slanted at an angle with respect to the female connector 2, so that a corner of a tip portion 7'*a* of one of the guide ribs 7' and an inner face in a sidewall 5*a* on the locking arm chamber 5 strike each other, a corner of a tip portion 9*a* of the bending preventing piece 9 and a sidewall 7'*b* of one of the guide ribs 7' strike each other, and a corner of an opening 5' of the locking arm 5 and a sidewall 7'*b* of one of the guide ribs 7' strike each other. When the situation as depicted in FIG. 3 occurs, the male connector 1 slightly enters the female connector 2 in the direction of the terminals 11 in the hood 3, but because the bending preventing piece 9 is longer than the terminals 11 protruding from the front end of the housing body 2', the male connector 1 and the female connector 2 cannot be connected with each other.

Therefore, in the event that the male connector 1 is mistakenly fitted so as to be slanted at an angle with respect to the female connector 2, the male connector 1 and the female connector 2 are prevented from being connected with each other by means of the bending preventing piece 9, the terminals 11 are prevented from being bent, and the locking arm is prevented from being deformed and damaged.

Figure 4:
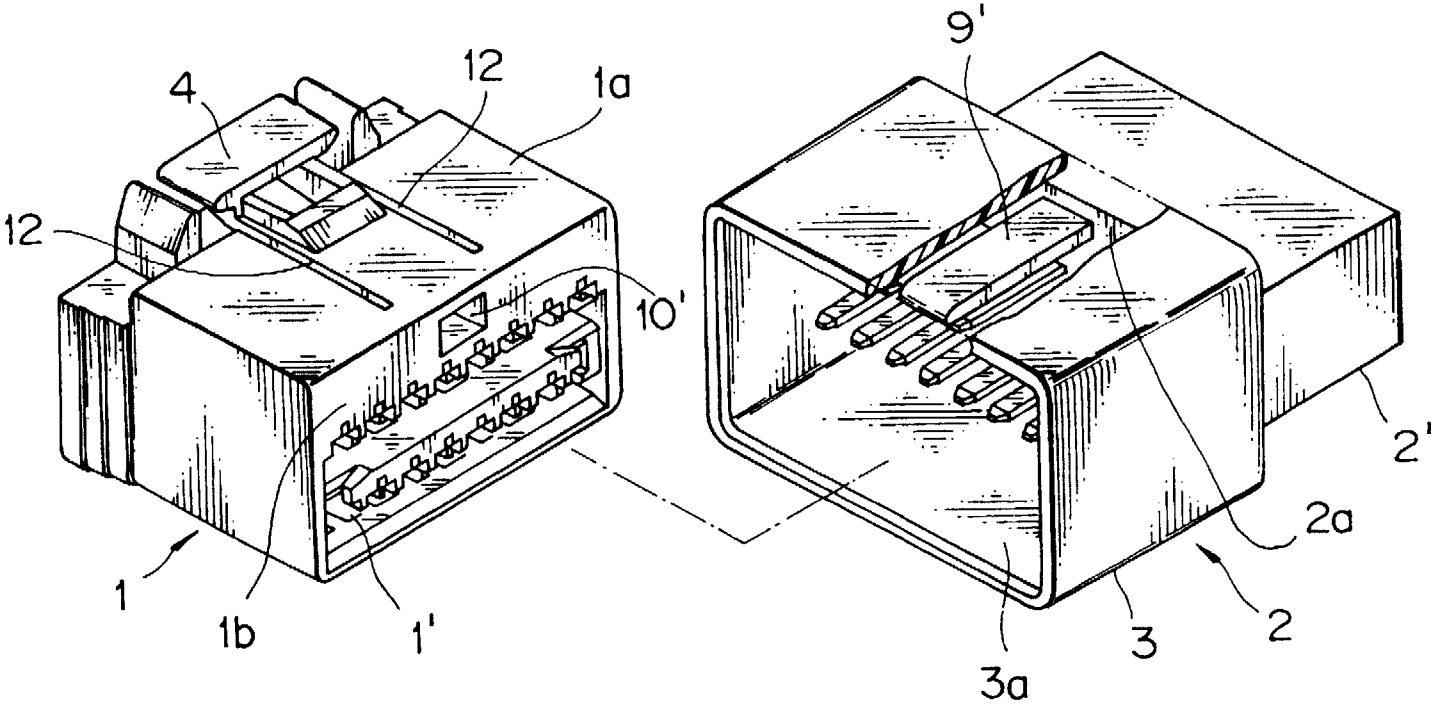
FIG. 4 is a perspective view of a second embodiment of the electrical connector according to the present invention showing the male and female connectors thereof in a disconnected state.

FIG. 4 shows the second embodiment of the electrical connector according to the present invention. The components of the second embodiment which are the same as those of the first embodiment will be given the same reference characters.

Referring to FIG. 4, a pair of concave portions or slits 12 are formed at an upper wall face 1*a* in the male connector 1. The locking arm 4 is mounted between the concave portions 12 and an escape portion 10' for receiving the bending preventing piece 9' of the female connector 2. The escape portion 10' is formed a front end face 1*b* of the male connector 1. The bending preventing piece 9' acts as a member to prevent the bending of the terminals 11. The bending preventing piece 9' protrudes from a front end face 2*a* of the female connector 2 in the direction of an opening 3*a* in the hood 3. As the bending preventing piece 9' of the second embodiment is of the same configuration as that of the bending preventing piece 9 of the first embodiment, a detailed description of the bending preventing piece 9' will be omitted herein.

As a variation to the second embodiment, it is possible to form guide ribs (not shown), similar to the guide ribs 7 shown in FIG. 1), on at least one side of the escape portion 10' by recessing the front end face 1*b* of the male connector 1. It is also possible to form guide grooves (not shown) in the hood 3 of the female connector 2. The guide grooves (not shown) would be similar to the guide grooves 8 shown in FIG. 1 for receiving the guide ribs 7 in the hood 3 of the female connector 2 and would be for a similar purpose. Moreover, it is also possible to form a raised portion (not shown), which is similar to the raised portion 4' shown in FIG. 1, by recessing the front end face 1*b* of the male connector 1 and the escape portion 10' in the raised portion 4', for receiving the bending preventing piece 9', and to form the locking arm chamber (not shown), similar to the locking arm chamber 5 shown in FIG. 1, for receiving the locking arm 4 in the hood 3 of the female connector 2.

Figure 5:
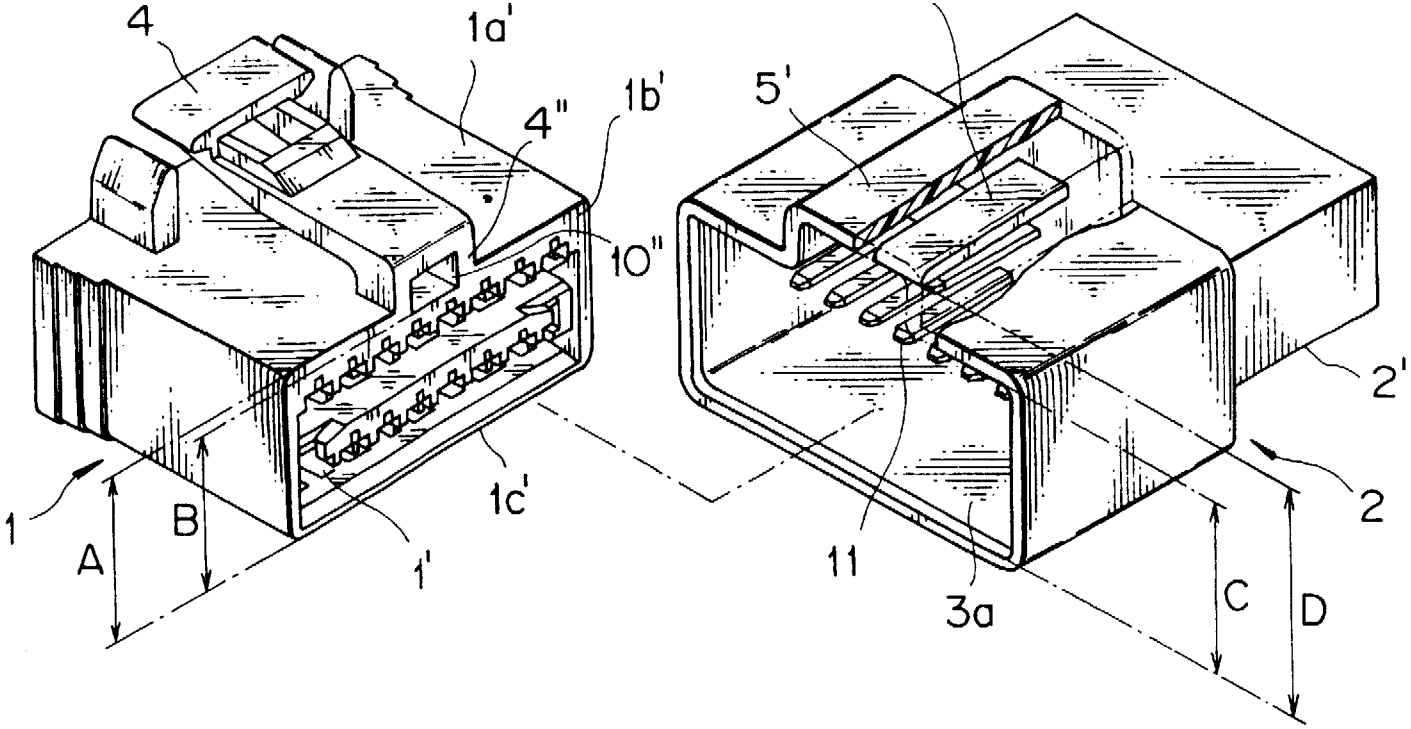
FIG. 5 is a perspective view of a third embodiment of the electrical connector according to the present invention showing the male and female connectors thereof in a disconnected state.

FIGS. 5 and 6 show the third embodiment of the electrical connector according to the present invention.

As shown in FIG. 5, the male connector 1 has a flat upper wall outer face 1*a'* and a flat lower wall outer face 1*c'* with a height A therebetween. The locking arm 4 is formed on a raised portion 4" which is mounted on the flat upper wall outer face 1*a'*. The hood 3 of the female connector 2 has a locking arm chamber 5' for receiving the locking arm 4 of the male connector 1. A bending preventing piece 9" protrudes from the front end of the housing body 2' of the female connector 2. An escape portion 10" is formed in the raised portion 4" of the male connector 1 for allowing ingress of the bending preventing piece 9" of the female connector 2 when the male connector 1 is inserted into the female connector 2. The bending preventing piece 9" of the third embodiment is of the same configuration as that of the bending preventing piece 9 of the first embodiment, and thus a detailed explanation of the bending preventing piece 9" will be omitted herein.

Figure 6A:
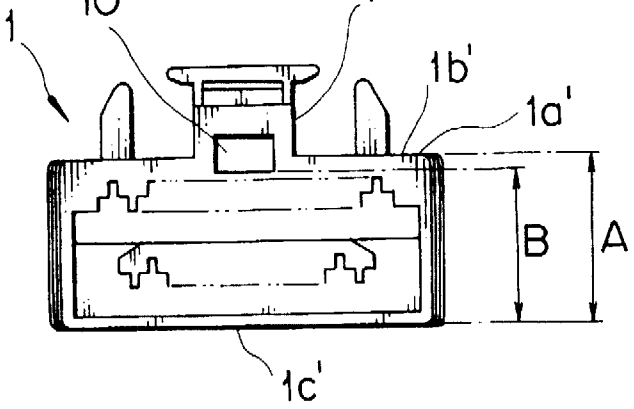
FIG. 6A is a front elevational view of the male connector of FIG. 5.
Figure 6B:
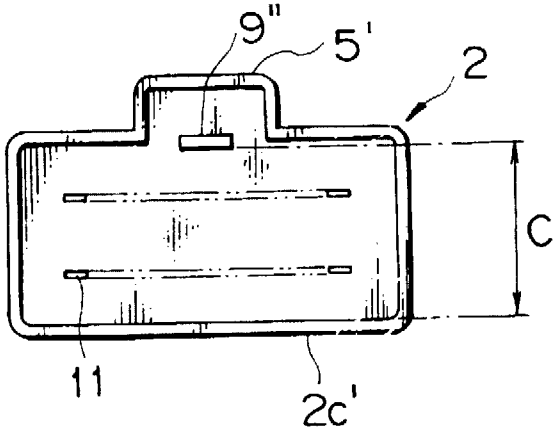
FIG. 6B is a front elevational view of the female connector of FIG. 5.

As shown in FIGS. 5 and 6A, the bottom of escape portion 10" of the male connector 1 is at a height B from the lower wall outer face 1*c'* of the male connector 1. As shown in FIGS. 5 and 6B, the bottom of the bending preventing piece 9" is at a height C from an inner face of the lower wall 2*c'* of the female connector 2. The escape portion 10" and the bending preventing piece 9" are located so that the relationship of the heights A, B, and C satisfies the equation $B<C<A$.

By locating the escape portion 10" and the bending preventing piece 9" so that heights A, B, and C satisfy the relationship of the above-stated equation, even if the male connector 1 is mistakenly fitted so as to be slated at an angle with respect to the female connector 2, the bending preventing piece 9" strikes the male connector 1 at a location between the lower wall face 1*c'* and the bottom of the escape portion 10", and the male connector 1 does not connect with the female connector 2 so that the terminals 11 in the female connector 2 are prevented from being bent.

Figure 7:
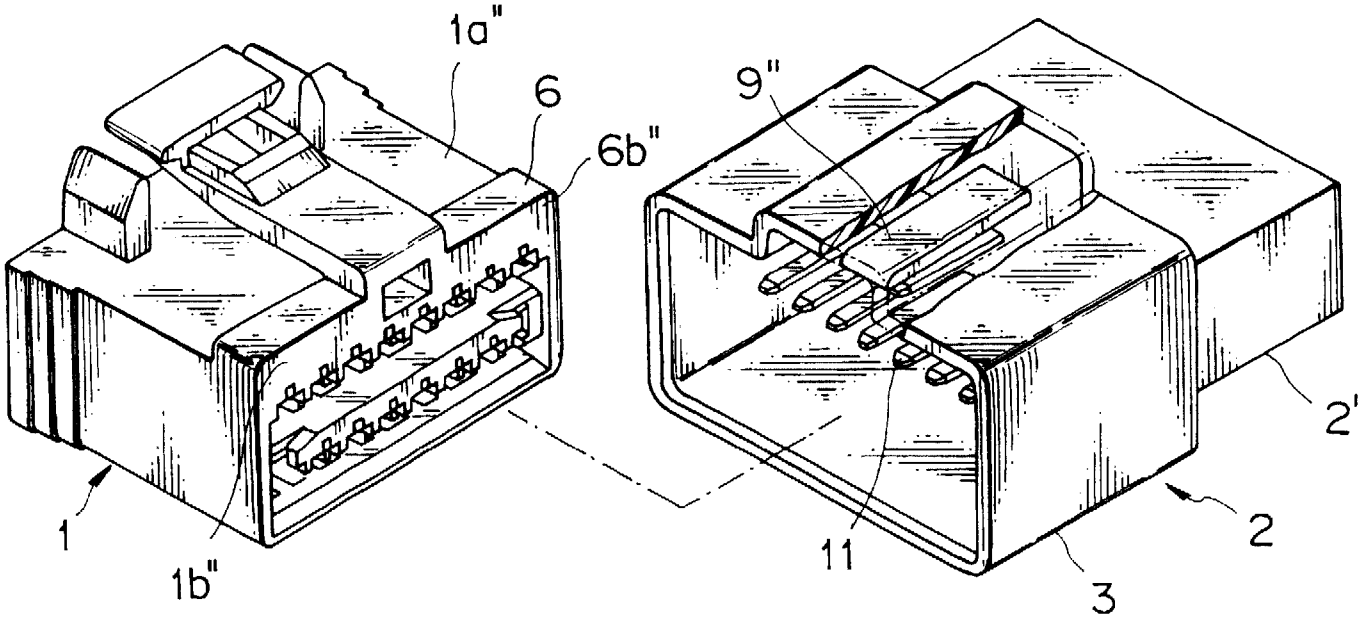
FIG. 7 is a perspective view of a forth embodiment of the electrical connector according to the present invention showing the male and female connectors in a disconnected state.
Figure 8:
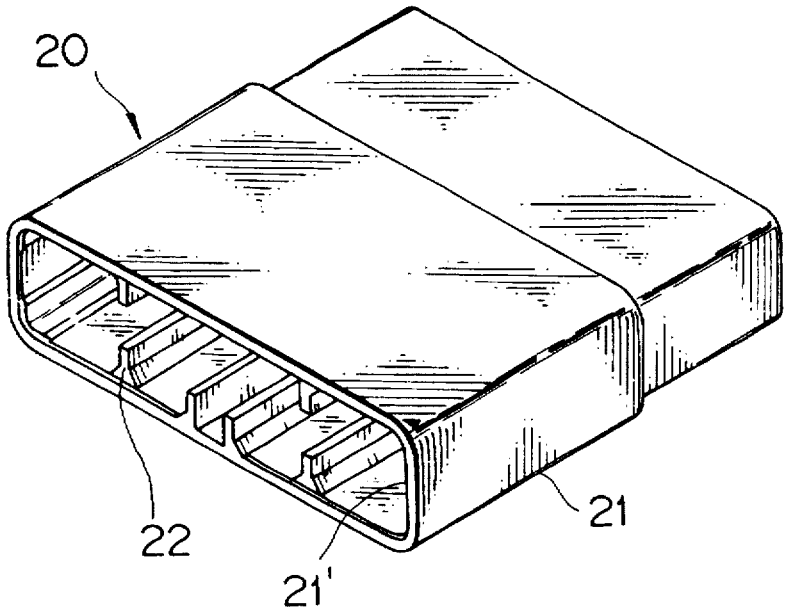
FIG. 8 PRIOR ART
FIG. 8 is a perspective view of a female connector of a conventional electrical connector.
Figure 10:
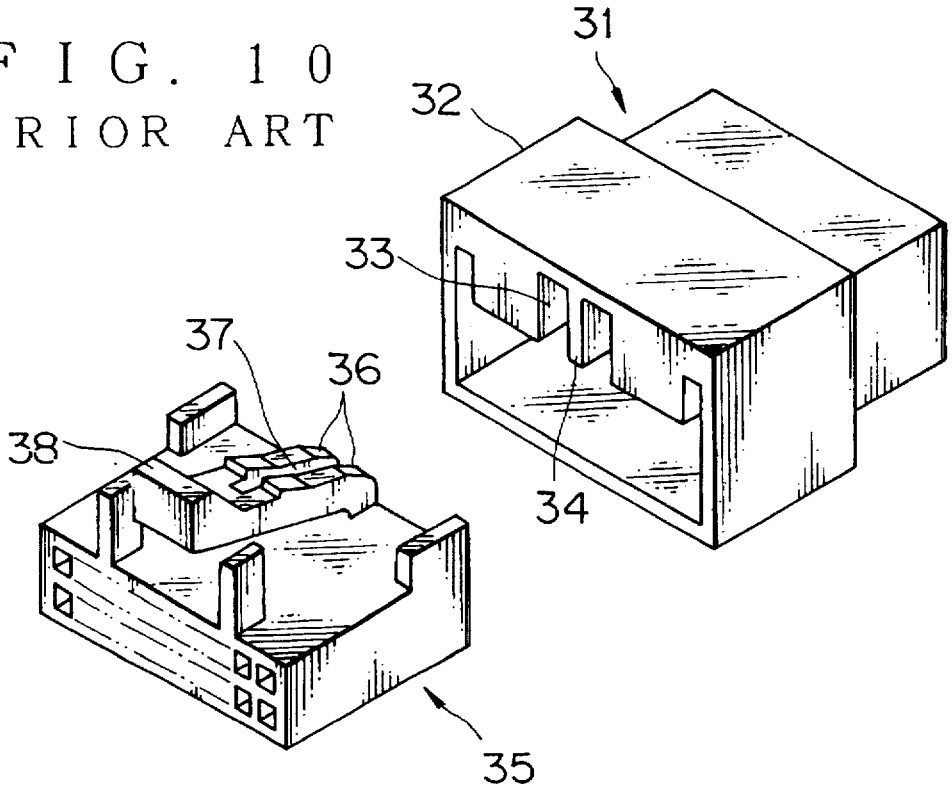
FIG. 10 PRIOR ART
FIG. 10 is a perspective view of still another conventional electrical connector showing male and female connectors in a disconnected state.
Figure 9:
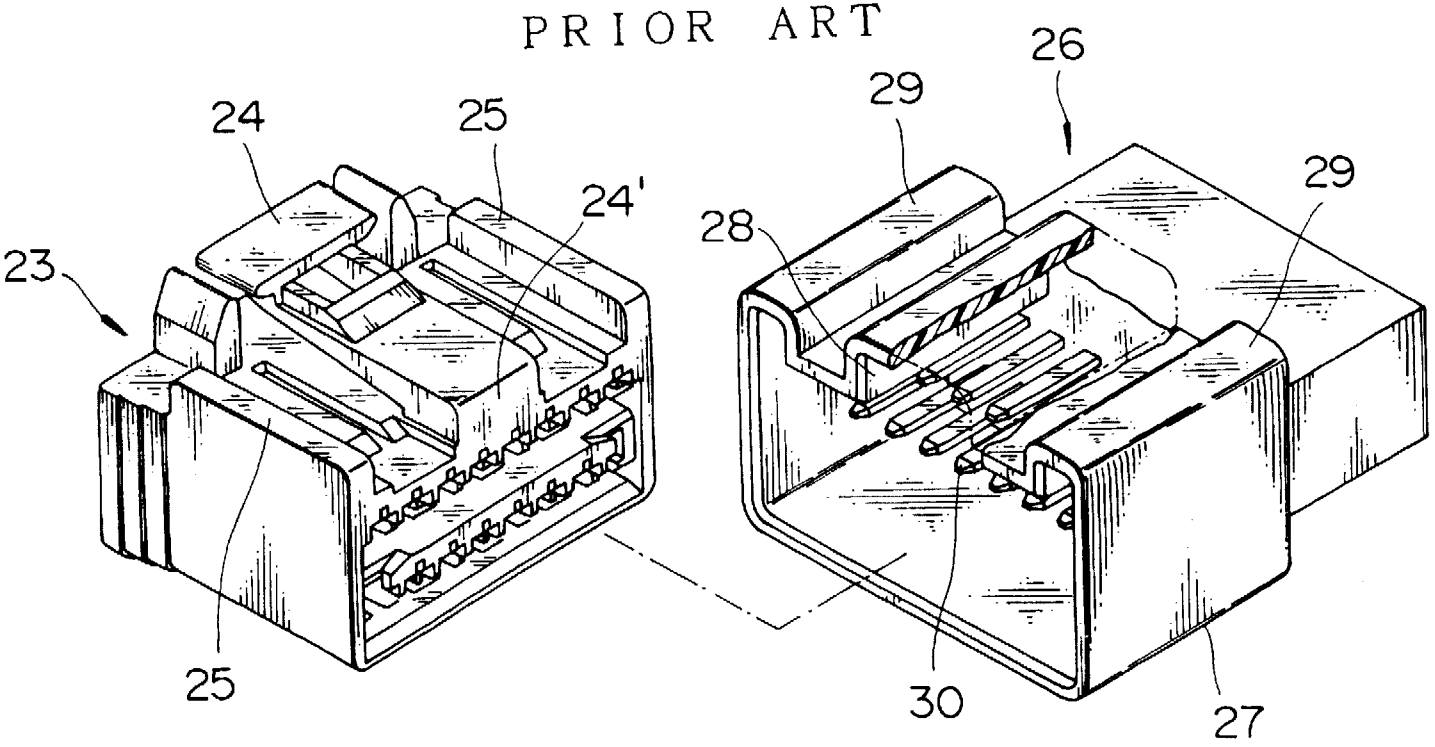
FIG. 9 PRIOR ART
FIG. 9 is a perspective view of another conventional electrical connector showing male and female connectors in a disconnected state.

Referring to FIG. 7, the fourth embodiment of the electrical connector according to the present invention is shown. It is possible that the terminals 11 are prevented from being bent by the bending preventing piece 9" of the female connector 2 striking a sidewall 6*b"* of a raised wall 6 formed on and upper wall 1*a"* on the side of the front end face 1*b"* of the male connector 1.

In all embodiments described above, it is preferable that the bending preventing piece 9 (9', 9") protrudes from the front end of the housing body 2' so as to be located approximately at the center of the width of the female connector 2 and within an upper half in the hood 3 of the female connector 2. However, the bending preventing piece 9 (9', 9") may also protrude from another location within the upper half in the hood 3. If the bending preventing piece 9 (9', 9") is arranged at the center of the width of the female connector 2 in the event that either the left-hand side or right-hand side of the male connector 1 is mistakenly fitted so as to be slanted at an angle with respect to the female connector 2 so as to prevent any of the terminals 11 from being bent, the bending preventing piece 9 (9', 9") is more properly located at the center in the hood 3 than at either the left-hand side or the right-hand side of the hood 3.

What is claimed is:

1. An electrical connector comprising:

a male connector;

a female connector for at least partially housing therewithin said male connector;

a locking arm mounted on an upper wall face of said male connector;

a bending preventing member extending from an inner wall face of said female connector toward an opening in said female connector; and an escape portion formed through a front end face of said male connector below said locking arm and on a side of said male connector which faces a front end of a housing body of said female connector so as to allow said bending preventing member mounted on said front end of said housing body to enter said escape portion, and prevent terminals of said female connector from being bent by said bending preventing member of said female connector contacting said front end face of said male connector when said male connector is mistakenly fitted so as to be slanted at an angle with respect to said female connector.

2. An electrical connector comprising:

a male connector;

a female connector for at least partially housing therewithin said male connector;

a locking arm mounted on an upper wall face of said male connector;

a bending preventing member extending from an inner wall face of said female connector toward an opening in said female connector; and an escape portion formed through a front end face of said male connector below said locking arm and on a side of said male connector which faces a front end of a housing body of said female connector so as to allow said bending preventing member mounted on said front end of said housing body to enter said escape portion, preventing terminals of said female connector from being bent by said bending preventing member of said female connector contacting a sidewall of said male connector when said male connector is mistakenly fitted so as to be slanted at an angle with respect to said female connector.

* * * * *